US005662489A

United States Patent [19]

Stirling

[11] Patent Number: 5,662,489

[45] Date of Patent: Sep. 2, 1997

[54] ELECTRICAL COUPLING WITH MATING TAPERS FOR COAXIAL CABLE HOUSINGS

[75] Inventor: Albert Stirling, Markham, Canada

[73] Assignee: Stirling Connectors Inc., Markham, Canada

[21] Appl. No.: 458,636

[22] Filed: Jun. 12, 1995

[51] Int. Cl.[6] ..... H01R 4/38

[52] U.S. Cl. ..... 439/322; 439/339; 439/578

[58] Field of Search ..... 439/320, 321, 439/322, 339, 675, 578, 583, 584, 884

[56] References Cited

U.S. PATENT DOCUMENTS

| | | | |
|---|---|---|---|
| 2,513,080 | 9/1950 | Burtt | 439/322 |
| 2,897,470 | 7/1959 | Klassen | 439/320 |
| 2,986,720 | 5/1961 | Chess | 439/322 X |
| 3,997,230 | 12/1976 | Secretan | 439/322 X |
| 4,296,986 | 10/1981 | Herrmann, Jr. | 439/322 |
| 4,405,196 | 9/1983 | Fulton | 439/884 X |

*Primary Examiner*—Khiem Nguyen
*Attorney, Agent, or Firm*—Bereskin & Parr

[57] ABSTRACT

An electrical coupling is provided for connecting two coaxial cable housings. The coupling has male and female components which have mating tapered surfaces, such as conical surfaces. Screwing the male and female components together wedges the conical surfaces tightly so that the coupling is resistant to torsional forces that could otherwise cause rotational displacement of the components and lead to unscrewing of the coupling.

8 Claims, 2 Drawing Sheets

10
14
15
16
20
21
22
23
25
26
30
31
32
33
34
35
36
40
41
42
43
44

ELECTRICAL COUPLING WITH MATING TAPERS FOR COAXIAL CABLE HOUSINGS

FIELD OF THE INVENTION

This invention relates generally to electrical couplings, in particular electrical couplings for connecting two coaxial cable housings.

On coaxial cable lines it is sometimes desirable to mount two contiguous housings. For example, hard line coaxial cable that is used for distributing cable television signals may have amplifiers spaced at intervals to boost the signal to overcome attenuation. Junctions, or splitter boxes, are also spaced at intervals along such cable to feed branch lines to multiple users. Not infrequently, amplifier housings are mounted directly to junction housings along such cable. In these situations, electrical couplings are used to connect the two housings.

Known electrical couplings for connecting such housings have certain disadvantages. The simplest known coupling comprises a body with two cylindrical components that each have a nipple adapted to screw into standard threaded receptacles of respective housings, and an insulated conducting pin extending therethrough. A nut rotatably mounted to one of the components screws onto the other component drawing them together until the facing flat edges of the two components abut one another.

Such couplings have been known to work themselves undone, particularly in installations where the cable is suspended and subject to being blown by the wind. The swaying cable tends to twist back and forth repeatedly, producing torsional forces that can loosen, and ultimately undo the nut of the coupling. Even where the nut is not completely undone, having it loosened may lead to moisture penetration and signal leakage.

In answer to this problem, it has been proposed to provide a similar coupling body but modified so that the facing edges of the two components are each machined to provide interlocking castellations that prevent torsional displacement. Such machining though adds considerably to the cost of manufacture. Moreover, as the two components can only be screwed together in certain relative alignments (that is, so that their castellations can fit together), known commercial couplings of this type are also provided with additional rotating joints between the nipple portions and the interlocking portions of the two components, so that the two connected housings can be oriented as desired (for example, both aligned upright) with the coupling tightened fully on each housing. This feature adds yet more to the cost of such couplings.

It is an object of the present invention to obviate or mitigate the disadvantages of such known electrical couplings for coaxial cable housings.

SUMMARY OF THE INVENTION

In accordance with the present invention, there is provided an electrical coupling body for connecting two coaxial cable housings comprising a female component with a tapered recess, and a male component with a corresponding tapered arm.

The female component has a bore through it that is adapted to receive a conducting pin, which is insulated therein. One end of the female component has a nipple that is adapted to mount into a receptacle on one of the two housings to be connected. The other end of the female component has a recess shaped generally as a tapered surface of revolution.

The male component also has a bore through it that is adapted to receive the conducting pin, which is insulated therein. One end of the male component has a nipple which is adapted to mount into a receptacle on the other one of the two housings. The other end of the male component has an arm with an external taper corresponding to the taper of the recess in the female component so that the arm is adapted to fit matingly into the recess of the female component.

A nut is rotatably mounted to one of the two components, and adapted to screw onto the other one of the components.

The components are engageable to one another after each has first been mounted to one of the housings, with the conducting pin extending from one housing to the other housing through the components and insulated from them, by sliding the tapered arm of the male component into the tapered recess of the female component, and then screwing the nut mounted to the one component onto the other component and thereby drawing the two components together. Because the abutting surfaces of the arm and recess are tapered, drawing the two components toward each other also wedges the arm tightly into the recess. The coupling can thereby be given resistance to torsional forces that could otherwise cause rotational displacement of the components and lead to unscrewing of the coupling.

Advantageously the coupling body is pre-assembled with a conducting pin extending through the bores of each of the two components and outwardly beyond the nipples, held in position not to contact the coupling body by insulating spacers in the bores of the two components. More advantageously, the electrical coupling also includes O rings to provide moisture barriers between the nut and the two components, and also between the two nipples and the two housings.

Preferably, the male and female components are both made of aluminum, and the mating tapers are frustoconical sections. Most preferably, the taper is approximately 3°.

It has been found that notwithstanding its simplicity and relatively low cost to manufacture, the electrical coupling of the present invention provides highly effective resistance to rotational displacement between the two components. Thus, the coupling of the present invention is well adapted to withstand being loosened by the torsional forces of twisting cables set into motion by wind and so forth, and to do so in a cost effective way.

Moreover, the components of the coupling can be brought together and tightened effectively to resist rotation regardless of each component's orientation after being mounted to the respective housing. There is no need to provide additional rotating joints, as with the castellated coupling mentioned above, to be able to tighten the coupling with the two housings in any desired orientation. The two components can be slid together in a rotation resistant friction fit regardless of their orientations.

Preferably, the nipples of both the male and female components have standard threading to screw into standard threaded receptacles used on coaxial cable housings. Most preferably, each of the two components and the nut are provided with opposing flat surfaces to facilitate the use of common wrenches to screw and tighten them into position.

BRIEF DESCRIPTION OF THE DRAWINGS

In order that the invention may be more clearly understood, reference will now be made to the accompanying drawings in which.

DESCRIPTION OF THE PREFERRED EMBODIMENT

Figure 1:
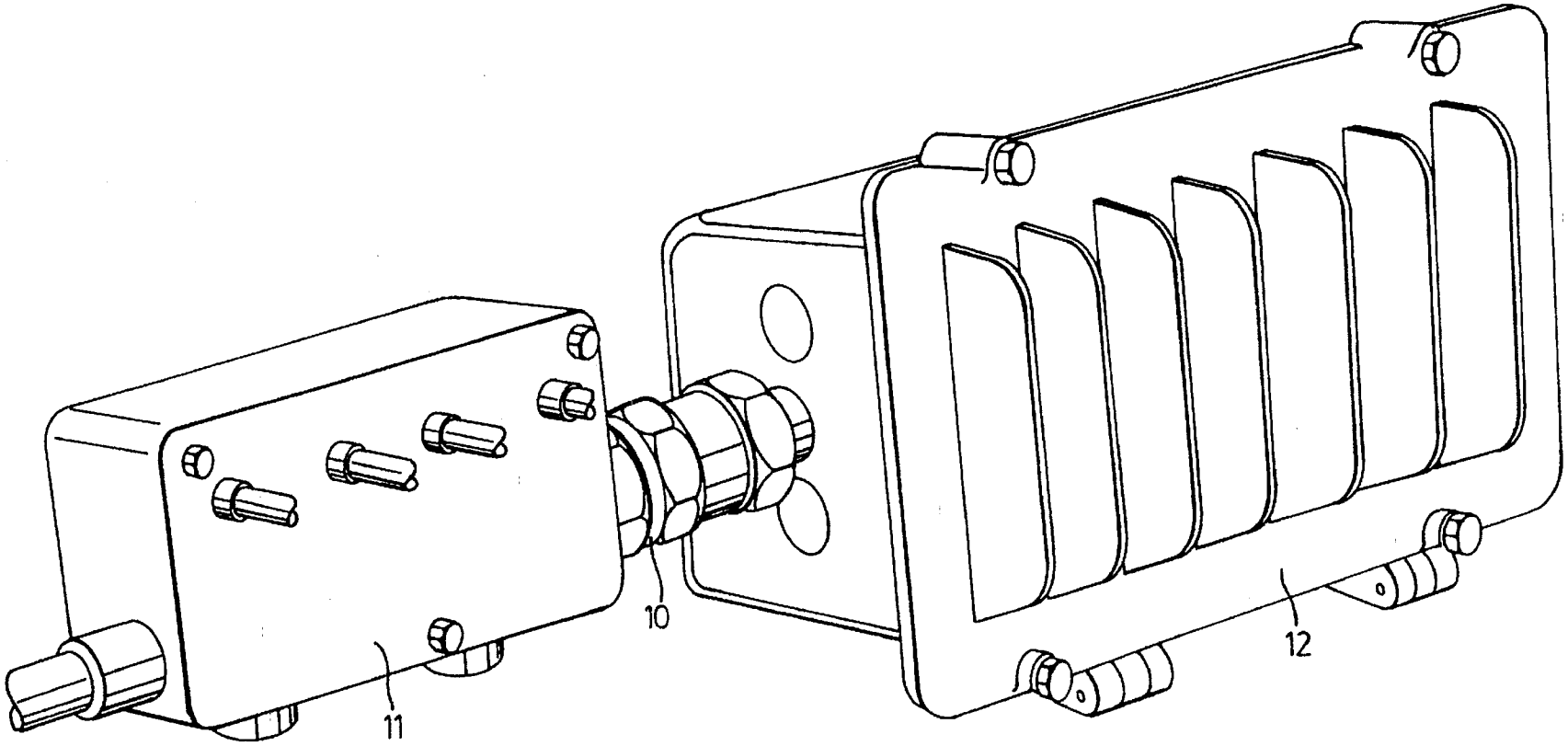
FIG. 1 is a perspective view of one embodiment of an electrical coupling according to the present invention, the coupling being shown in use connecting to coaxial cable housings.
Figures 2, 3:
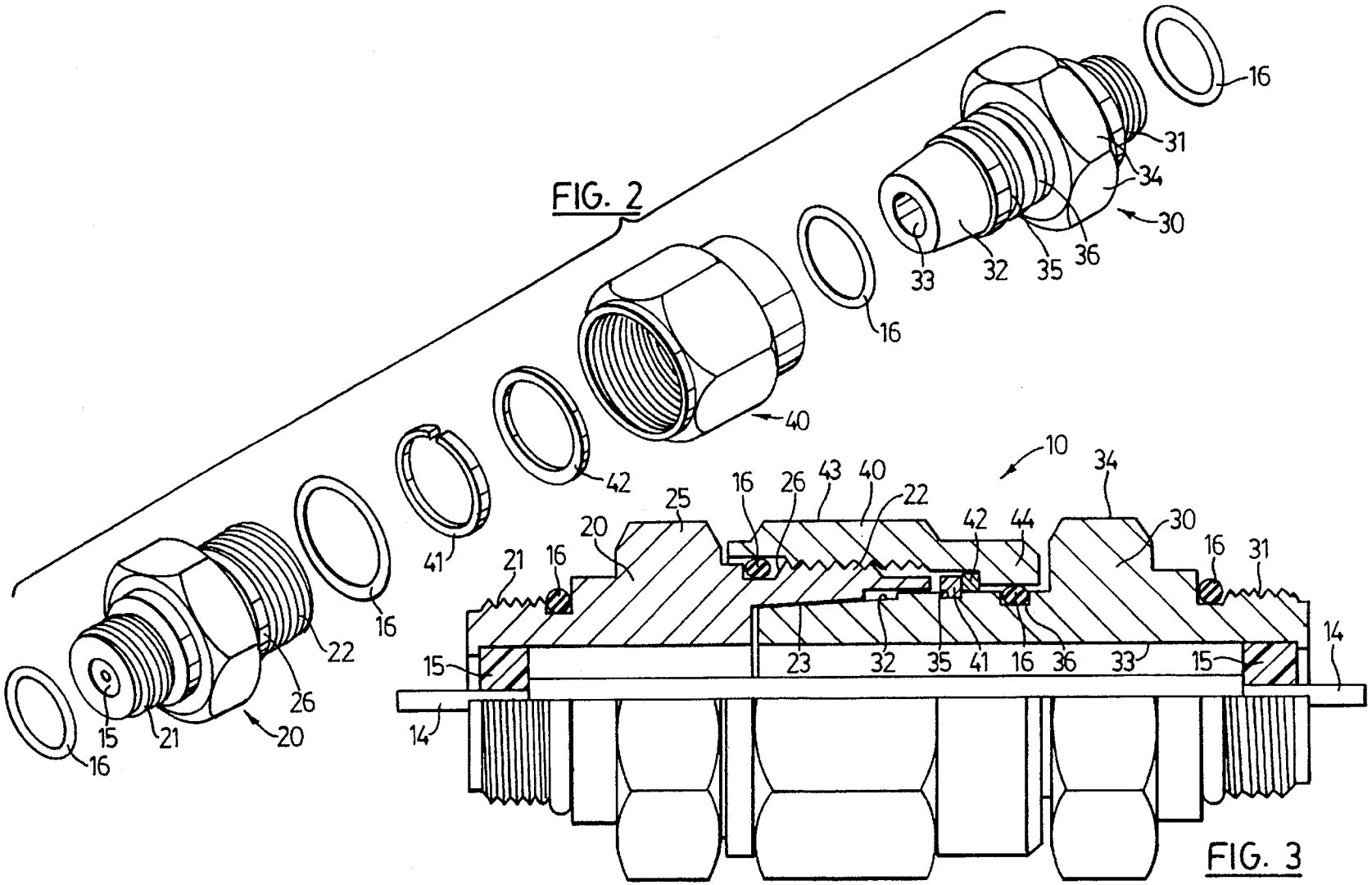
FIG. 2 is an exploded perspective view of the coupling of FIG. 1.
FIG. 3 is a cross-sectional side view of the electrical coupling of FIGS. 1 and 2.

In the drawings, the electrical coupling of the present invention is designated generally by reference numeral 10. The coupling 10 comprises a female component 20 and a male component 30. A nut 40 is rotatably mounted to the male component 30. Each of the male and female components 20, 30 and the nut 40 are generally cylindrical and are produced from 15/16 inch hexagonal aluminum bar stock, grade 6262-T6.

The female component 20 has at one end a nipple 21 with a standard 5/8-24 UNEF-2A threading to screw into a standard threaded receptacle 13 on a coaxial cable housing, represented in FIG. 1 by a junction box 11. At the other end of the female component 20 is an externally threaded sleeve 22 having a conical recess 23. A cylindrical bore 24 extends concentrically through the remainder of the female component 20. A portion of the body between the nipple 21 and the sleeve 22 is provided with hexagonal flats 25.

The male component 30 also has at one end a nipple 31 which is similarly provided with standard threading to be screwed into a threaded receptacle of a coaxial cable housing, represented in FIG. 1 by an amplifier box 12.

At its other end, the male component 30 has an arm 32 which is conically tapered to fit tightly within the recess 23 of the female component 20. Both the recess 23 and the arm 32 are machined to mating frustoconical tapers of 3° with a tolerance of 0°±10'. The diameter of the end of the tapered arm 32 is identical to the diameter of the bottom of the tapered recess 23 with a tolerance of plus or minus 0.001 inch.

A cylindrical bore 33 extends concentrically through the male component 30. A portion of the body, between the nipple 31 and the tapered arm 32 is provided with hexagonal flats 34. Between the hexagonal flats 34 and the tapered portion of the arm 32 the body has a generally cylindrical portion with two grooves 35, 36.

The nut 40 has internal threading corresponding to the external threads on the sleeve 22 of the female component 20. The nut 40 is provided with hexagonal flats 43 and is rotatably mounted to the male component 30 by means of a "C" shaped spring clip 41. The nut 40 has an internal rim 44 having an internal diameter slightly larger than the cylindrical portion of the male component 30 but smaller than the spring clip 41. A washer is mounted between the rim 44 of the nut 40 and the spring clip 41. The nut 40 is assembled with the male component 30 by placing it over the arm 32 such that the rim 44 is positioned on the cylindrical portion of the male body 30 between the groove 35 and the hexagonal flats 34. The washer 42 is then placed in position, over the arm 32 and nesting on the cylindrical portion of the male component 30, between the groove 35 and the rim 44 of the nut 40. The spring clip 41 is then pushed over the arm 32, its diameter being stretched until it reaches the groove wherein its diameter springs back so that it is held within the groove 35.

O rings 16 are mounted within the groove 36 of the male component 30 and a groove 26 of the female component 20 to provide a moisture barrier between the components 20, 30 and the nut 40. O rings 16 are also mounted next to the nipples 21, 31 to provide a moisture barrier between the female and male components 20, 30 and the housings 11, 12.

A brass conducting pin 14 extends through the female and male components 20, 30 and beyond the nipples 21, 31 to be connected within the respective housings 11, 12. The conducting pin 14 is held concentrically within the bores 24, 33 of the female and male components 20, 30 by means of insulating spacers 15, which are generally disk shaped, having an outer diameter to be frictionally retained within the bores 24, 33 and having a central hole with a diameter to frictionally retain the conducting pin 14.

The coupling 10, which would generally be shipped with the male component 30 and the female component 20 engaged to one another by means of the nut 40 and with the conducting pin 14 extending therethrough, would be used by first disengaging the nut 40 from the female component 20, and then screwing the nipple 21 of the female component 20 into a first housing 11 and screwing the nipple 31 of the male component 30 into the second housing 12. The conducting pin 14 can be moved slidingly back and forth within the insulating spacers 15 to facilitate the connection.

After the female and male components 20, 30 have each been mounted to one of the housings 11, 12, the female and male components 20, 30 are brought together and the tapered arm 32 is slid into the tapered recess 23. The nut 40 is thereafter screwed onto the threaded sleeve 22 of the female component 20, drawing the tapered arm 32 of the male component 30 tightly into the tapered recess 23 of the female component 20, thereby securing the engagement of the two components 20, 30 to resist torsional displacement. The conducting pin 14 can then be secured to the connections within the two housings 11, 12.

It will of course be appreciated that many variations are possible within the broad scope of the present invention. For example, while in the preferred embodiment described above, the nut is rotatably mounted to the male component and screws onto the female component, in another embodiment, the nut could be rotatably mounted to the female component and screw onto the male component.

Furthermore, while the embodiment described above has frustoconical tapers of 3° on the arm and sleeve, other surface of revolution taper profiles could be used instead, provided they were effective to give adequate resistance to torsional displacement between the mating tapered surfaces.

Moreover, while the embodiment described is made of aluminum, other materials could be substituted, provided they have the desired properties of strength, conductivity and corrosion resistance; in addition, the surface hardness of the material should be effective in providing a satisfactorily high coefficient of friction to give adequate resistance to torsional displacement between the mating tapered surfaces.

I claim:

1. An electrical coupling body for connecting two coaxial cable housings, comprising:

a female component with a bore therethrough adapted to receive a conducting pin insulated therein, one end of said female component having a nipple adapted to mount into a receptacle on one of said housings, the other end having a recess shaped generally as a tapered surface of revolution, a male component with a bore therethrough adapted to receive such conducting pin insulated therein, one end of said male component having a nipple adapted to mount into a receptacle on the other one of said housings, the other end having a tapered arm adapted to fit matingly into said recess of said female component, a nut rotatably mounted to one of said components, adapted to screw onto the other of said components, said components being engageable to one another without rotational re-orientation after each has first been mounted to one of said housings, with such conducting pin extending therethrough and insulated therefrom, by sliding said tapered arm of said male component into said tapered recess of said female component and screwing said nut onto said other component to draw said tapered arm and recess of said components tightly together, thereby securing the engagement of said female and male components to resist rotational displacement due to subsequently applied to torsional forces.

2. The coupling body of claim 1, wherein said recess and said arm are generally frustoconical.

3. The coupling body of claim 2, wherein the taper of each of said recess and said arm is approximately 3°.

4. The coupling body of claim 3, wherein each of said female and male components and said nut are of aluminum.

5. The coupling body of claim 4, wherein each of said female and male components and said nut further have external opposing flats adapted to receive standard size wrenches.

6. The coupling body of claim 5, further comprising O rings to provide a moisture barrier between said female and male components and said nut, and to provide moisture barriers between said coupling and said housings.

7. The coupling body of claim 6, wherein said nipples are externally threaded to screw into standard internally threaded receptacles on said housings.

8. An electrical coupling for connecting two coaxial cable housings, comprising:

a generally cylindrical female component with a central axial bore through which and beyond extends a conducting pin within an insulating spacer, one end of said female component having an externally threaded nipple adapted to screw into an internally threaded receptacle on one of said housings, the other end of said female component having an externally threaded sleeve with a concentric tapered frustoconical recess therein, a generally cylindrical male component with a central axial bore through which and beyond extends said conducting pin within an insulating spacer, one end of said male component having an externally threaded nipple adapted to screw into an internally threaded receptacle on the other one of said housings, the other end of said male component having an arm fitting matingly into said recess of said female component with an external frustoconical taper corresponding thereto, a generally cylindrical nut having an internal thread adapted to screw onto said sleeve of said female component, said nut being rotatably mounted to said male component and being removably mounted screwwise to said female component, said female component being disengageable and re-engageable to said male component without rotational re-orientation by means of said nut after said female and male components have first been screwed securely into receptacles of the two respective housings, with such a conducting pin extending through said axial bores of both components and into said housings insulated therefrom, by sliding said tapered arm of said male component matingly into said tapered recess of said female component and screwing said nut onto said sleeve of said female component to draw said arm of said male component tightly into said recess of said female component, thereby securing the engagement of said female and male components to resist rotational displacement due to subsequently applied torsional forces.

* * * * *